United States Patent [19]

Dinnan et al.

[11] Patent Number: 4,860,624

[45] Date of Patent: Aug. 29, 1989

[54] ELECTRONIC MUSICAL INSTRUMENT EMPLOYING TRU-SCALE INTERVAL SYSTEM FOR PREVENTION OF OVERTONE COLLISIONS

[75] Inventors: James A. Dinnan; Joseph A. Dinnan, both of Athens, Ga.

[73] Assignee: Meta-C Corporation, Athens, Ga.

[21] Appl. No.: 223,840

[22] Filed: Jul. 25, 1988

[51] Int. Cl.[4] ..... G10H 1/00; G10H 3/03; G10G 7/02

[52] U.S. Cl. ..... 84/1.01; 84/454; 84/1.28

[58] Field of Search ..... 84/DIG. 18, 1.01, 1.28, 84/1.22, 1.23, 1.24, 454, 451

[56] References Cited

U.S. PATENT DOCUMENTS

| | | | |
|---|---|---|---|
| 4,152,964 | 5/1979 | Waage | 84/1.01 |
| 4,178,823 | 12/1979 | McCoskey et al. | 84/1.01 |
| 4,248,119 | 2/1981 | Yamada | 84/1.01 |
| 4,327,623 | 5/1982 | Mochida et al. | 84/454 |
| 4,434,696 | 3/1984 | Conviser | 84/1.01 |
| 4,498,363 | 2/1985 | Shimada et al. | 84/1.01 |

FOREIGN PATENT DOCUMENTS

| | | | |
|---|---|---|---|
| 3023578 | 1/1982 | Fed. Rep. of Germany | 84/454 |

*Primary Examiner*—A. T. Grimley
*Assistant Examiner*—Matthew S. Smith
*Attorney, Agent, or Firm*—Sughrue, Mion, Zinn, Macpeak & Seas

[57] ABSTRACT

An electronic musical instrument for reproducing chords in a fixed interval scale, know as Tru-Scale, without overtone collision. The instrument includes a memory for storing of frequency information corresponding to respective nots for producing tones using the Tru-Scale interval system. The inventive instrument reproduces single notes and chords in accordance with an interval system which eliminates dissonance, allows complete modulation, in all key signatures, and pure tone chords without altering the keyboard. The invention also contemplates the use of the Tru-Scale frequencies with all MIDI interface compatible instruments, in conjunction with a suitable tone generator, or through internal or external memory sources.

10 Claims, 7 Drawing Sheets

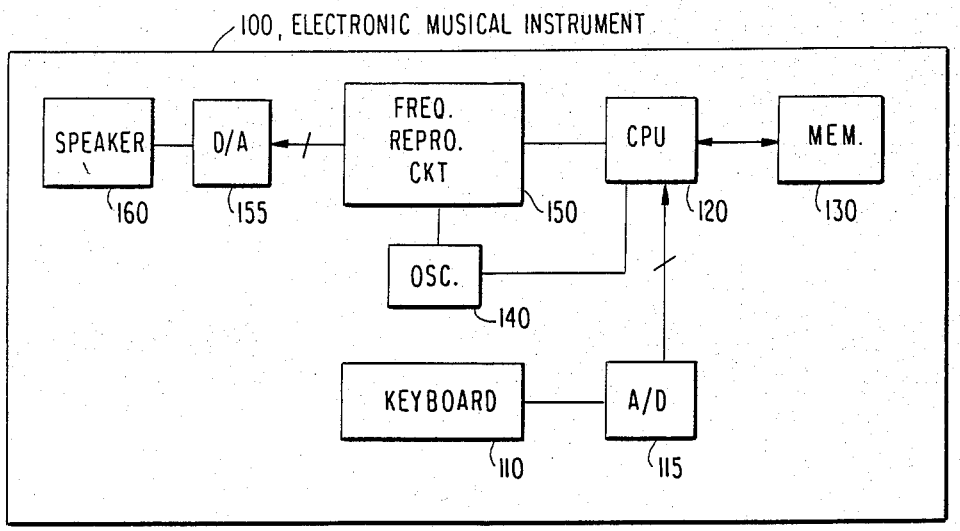
FIG. 1A
FIG. 1B
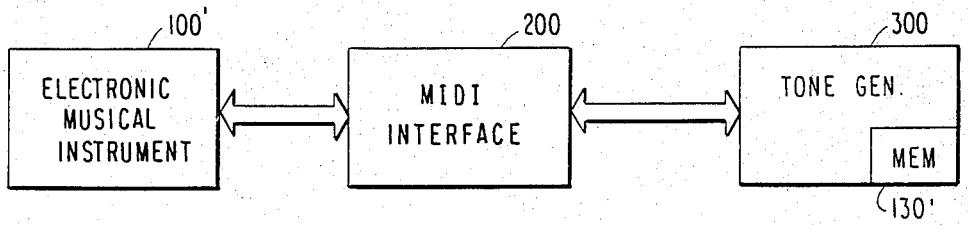

ELECTRONIC MUSICAL INSTRUMENT EMPLOYING TRU-SCALE INTERVAL SYSTEM FOR PREVENTION OF OVERTONE COLLISIONS

BACKGROUND OF THE INVENTION

The present invention relates to a new technique for eliminating overtone collisions in musical scales, and to a novel interval system for tuning of musical instruments wherein dissonances resulting from struck chords are eliminated. More particularly, the invention relates to an electronic musical instrument which reproduces musical scales so that normal struck chords, such as major fifths, do not have such dissonances. The invention is based on a wave system of communication which relies on a different basis of periodicity in wave propagation.

One problem in human communication since the first attempts to use and reproduce vibrations has been the development of a standard wave system of communication such that production of a wave of a given definition does not interfere with any other wave which occupies space. In the context of music, such interference causes overtone collisions, or dissonances, which can make individual notes, or melody lines in music difficult to identify and to follow.

Throughout history, there have been a number of interval system whose goal has been to minimize such dissonances. Four of the most widely-used such systems in auditory octave tuning for Western music are the Pythagorean, just intonation, meantone, and equal temperament intervals. These are defined, for example, in *The New Harvard Dictionary of Music,* (1986, Harvard Press). As described in that publication, pitch is calculated by a ratio involving logarithms, cents, and string lengths, all of which involve a measure of periodicity of waveforms based on $\pi=3.1416$.

None of the above-mentioned interval systems suffices, by itself, to prevent overtone collisions. Various attempts have been made to combine various ones of these systems as appropriate in electronic musical instruments, to minimize the degree of overtone collision present. Some of these now will be discussed.

U.S. Pat. No. 4,152,964, which relates to a correction of the "larger tuning errors of equal temperament as each interval or chord is played", switches intervals between equal temperament and just intonation, depending on whether a chord or a single note is to be played. Also in that patent is a discussion of some of the inherent deficiencies in the mathematical base from which the various then-known intervals were derived. It is useful to consider that discussion here:

> "No chromatic scale with tones of fixed pitch can yield perfectly tuned chords and also allow complete freedom of modulation. A scale composed of perfectly tuned chords must have notes whose frequencies form an arithmetical progression, while if the scale is to allow complete freedom of modulation, the notes must have frequencies that form a geometrical progression. In the first case, although the frequency differences are all congruent, the sizes of the various intervals, measured logarithmically, are not congruent with respect to the octave or with one another because the logarithms of simple interval ratios are irrational decimals. In the second case the sizes of the intervals, measured logarithmically, are congruent with one another and with the octave but now, since the interval ratios are all expressed as fractional powers of two, and hence irrational, all the intervals of such a scale except the octave are more or less out of tune.
>
> This dilemma which lies at the root of the difficulty of realizing just intonation with scales of fixed pitch, can be resolved by converting the present scale of equal temperament into a scale with tones of mutable pitch. Thus, the modulational advantage of the present scale is preserved by retaining the tempered fourths and fifths without alteration while the harmonic potentialities are greatly enlarged by the use of a keyboard controlled computer which automatically shifts the pitch of certain notes to correct the larger tuning errors of the scale.

The technique of the above-discussed patent, then, does not represent a systematic approach to elimination of overtone collision. The lack of a systematic approach makes the scales reproduced by the electronic musical instrument difficult to transpose into different keys. While equal temperament facilitates such transposition, the problem of overtone collision is serious.

Another illuminating discussion is found in U.S. Pat. No. 4,248,119, relative to the incompatibility of freedom of modulation in one system with chords of the same system, wherein it is stated:

> Generally, an electronic musical instrument is tuned in an equally tempered scale so that it is easy to modulate or transpose to other keys or to make ensemble performance with other musical instruments. However, when the electronic musical instrument is thus tuned with the equally tempered scale, such chord tones as major triad chord tones are not produced in perfect consonant intervals so that it constitutes one of the factors that disturb harmony. For example, when major triad chord tones are produced by a just intonation scale, the frequency ratio of the root note tone to the major third note tone is just "4:5", and the frequency ratio of the root tone to the perfect fifth note tone is just "2:3" and accordingly "4:6". On the other hand, when the major triad chord tones are produced with the equally tempered scale, the frequency ratio of the root note to the major third note is "4:5.03984". Thus, the pitch of the major note in the equally tempered scale become higher by 14 cents than that of the major third note in the just intonation scale. Furthermore, when major triad chord tones are produced in an equally tempered scale, the frequency ratio of the root note to the perfect fifth note is "4:5.993228". Thus, the pitch of the perfect fifth note in the equally tempered scale is lower by 2 cents than that of the perfect fifth note, in a just intonation scale. As a consequence, where chord tones are produced in a just intonation scale, clear tones can be produced with consonant intervals. On the other hand, where chord tones are produced in an equally tempered scale, the tones become a bit unharmonic.

Thus, in both of the just-quoted patents, there is recognition that no single interval system has been able to provide sufficient harmony for the different situations in which both single notes and chords are struck.

In U.S. Pat. No. 4,498,363, it is stated:

> "On the other hand, an instrument tuned according to the equal-temperament cannot obtain perfect chords when compared to an instrument tuned according to the temperament of just intonation. However, the instrument tuned according to the temperament of equal-temperament is capable of obtaining chords which sound substantially natural, and in addition, the modulation operation is simple. For this reason, general electronic keyboard instruments, piano, and the like were conventionally tuned according to the temperament of equal-temperament. However, the chords obtained from the keyboard instruments which are tuned according to the temperament of equal-temperament are not perfect chords as described before, and these instruments are unfit for use in teaching during chorus practice, for example.

In the above-mentioned U.S. Pat. No. 4,152,964, there is discussion of some of the disadvantages of both the just intonation and the equal temperament scales.

The disadvantages of fixed scale systems will be evident from the following description: It is well known that the just scale $CDE_1FGA_1G_1C$ which is generated by the perfectly tuned chords $FA_1C$, $CE_1G$ and $GB_1D$, contains the imperfect minor chord $DFA_1$ in which the note D is a comma too sharp relative to the note $A_1$. On a fixed scale basis, a perfectly tuned chord $D_1FA_1$ can be had only as the submediant triad in the key of F Major or as the mediant triad in the key of B Flat Major, by momentarily turning on either of these tonality stops. A further disadvantage of just intonation on a fixed scale basis is that the same mis-tuned triad DFA which would also be contained in the dominant ninth chord $GB_1$ $DFA_1$, renders that chord even more dissonant than the same chord in equal temperament.

Thus, there has been clear recognition in the prior art that no fixed-scale system has been known which eliminates overtone collision by itself. An interesting summary of the problem is provided in U.S. Pat. No. 4,434,696, wherein it is stated:

For centuries numerous scholars and critical listeners have argued that the influences of fixed-pitch instruments have contributed to a loss of correct pitch and have caused vocalists and instrumentalists not constrained by fixed pitch to sing and play "out of tune" either for equally tempered or "just" performance. Basic to this problem has been the lack of technological development in instruments for either tempered tuning or just intonation. An examination of the abundant literature on the subject discloses that no fixed-pitch or keyboard instruments have previously been proposed or built capable of approaching precisely equal tempered intervals, nor any that could accurately produce just intonation and all of its enharmonic notes or modulational pitch changes for either instructional or performance use.

SUMMARY OF THE INVENTION

In view of the foregoing, one of the objects of the present invention is to provide a novel and useful electronic keyboard instrument with a retrievable system of stored frequencies within an octave without any alteration of the present keyboard, in which the above described disadvantages have been overcome.

The present invention accomplishes what previous efforts have failed to achieve. According to the invention, there is provided a system of notes in an octave which allows complete freedom of modulation and perfectly tuned interval chords using a stored memory computer source as a signal for a predetermined assigned frequency or frequencies. The novel interval used is called Tru-Scale by the present inventors. With this novel interval, all of the advantages of fixed-scale intervals, such as relative ease of transposition, are retained, while the disadvantages, such as more severe overtone collision, are eliminated.

Tru-Scale tuning involves new mathematical principles of a standard unit of measurement, related to a new measure of periodicity of wave transmission. When applied to the sound production components of an electronic instrument, primary or secondary, or other wave producing equipment, this tuning system can profoundly enhance the equipment's sound or performance. The enhancement is accomplished by eliminating the amount of dissonance caused by overtone collision by providing simultaneous frequencies with independent time-space relationships.

In the present production of electronic sound, a controlled electric impulse is sent to an oscillator, in which the impulse is turned into a specific assigned frequency. It is important to note that the initial impulse, which ultimately ends up as a predetermined frequency, is determined by mathematical computations using logarithms based on the present imperfect mathematical system. These various divisions, Equal Temperament, Just Intonation, Meantone, Pythagorean, of sound represent many prior attempts to divide sound into a non-dissonate interval system.

The Tru-Scale tuning system solves the problem of dissonance by using a new mathematical base. The new base incorporates the curve imposed by nature on all moving objects, including sound waves. Current mathematics, which is used in all prior tunings, is calculated on a two dimensional plane. Tru-Scale tuning is based on a three dimensional mathematical mode. (This system takes into account the natural curve of wave travel). Therefore, intervals between waves can be calculated to move in unison with no dissonance or overtone collision. This cannot be done with current mathematical theory due to improper calculations of wave movement. Such improper calculations yield harmonic dissonance, as will be discussed below.

The overall effect of Tru-Scale tuning creates a much cleaner and stronger sounding interval system, which in turn creates better sounding chords. The mathematical foundation behind the Tru-Scale tuning can also be used to enhance all forms of wave production, transmission and reception.

BRIEF DESCRIPTION OF THE DRAWINGS AND PLATES

In the accompanying drawings and holographs:

FIG. 1A is a block diagram of an electronic musical instrument according to the present invention, FIG. 1B is a block diagram of a tone generator according to the present invention, connected through a suitable interface to an electronic musical instrument, and FIG. 1C is a block diagram showing the memory layout of a general construction of one embodiment of an electronic musical instrument to which the present invention may be applied;

DETAILED DESCRIPTION OF A PREFERRED EMBODIMENT

Figure 1C:
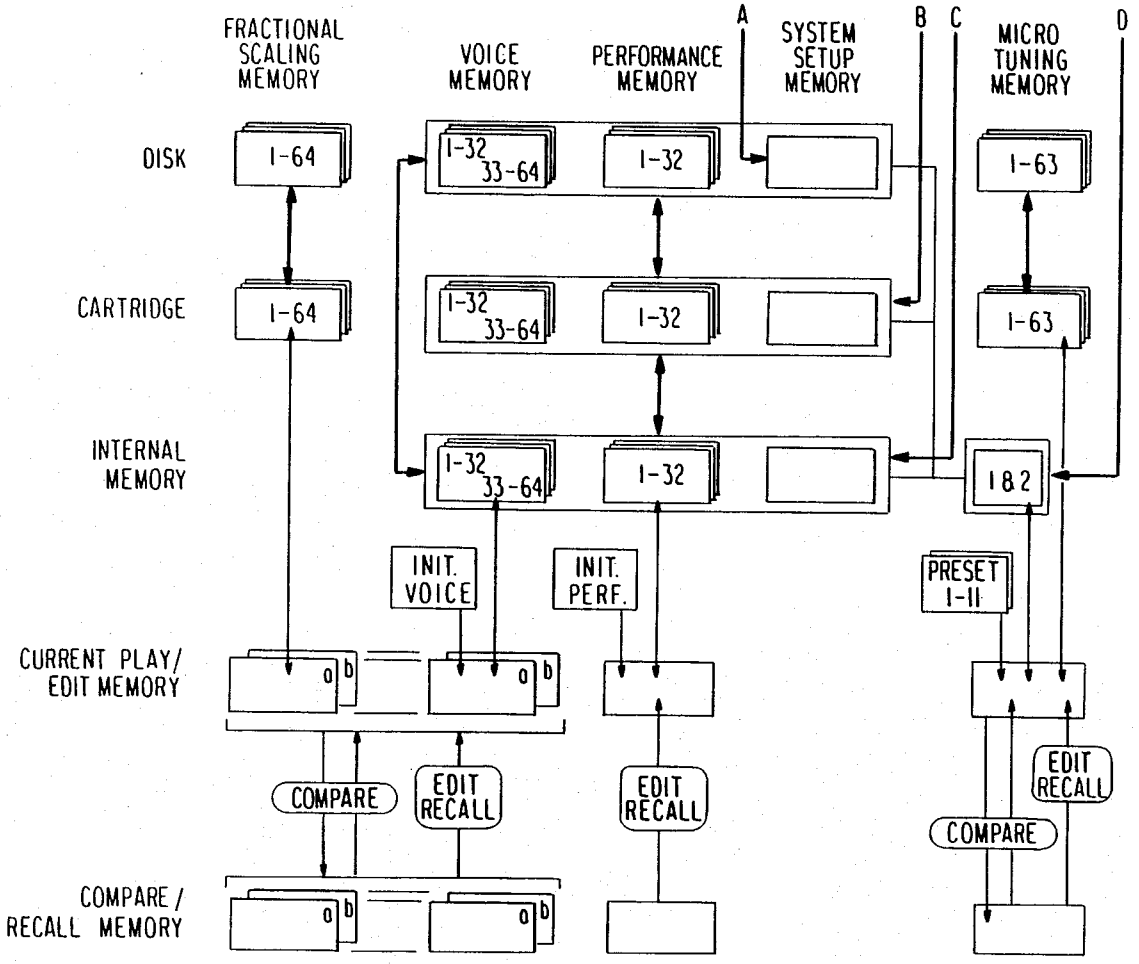

In FIG. 1A, an electronic musical instrument according to the present invention includes a keyboard 110, which may contain any desired number of keys. Typically, such keyboards may enable selection of keys from as many as four different octaves. An analog-to-digital (A/D) converter 115 converts the keyboard input to digital form for input to a central processing unit (CPU) 120, which preferably is a microprocessor.

A memory 130 stores Tru-Scale frequency values which are output in accordance with particular keys being struck. When single keys are struck, the memory 130 provides a single value which is reproduced through the frequency reproduction circuitry 150, a digital-to-analog (D/A) converter 155, and a loudspeaker 160. For reproduction of struck chords, the memory 130 provides a value for each key being struck, and the CPU controls timing of output of sound as a single chord, though the memory 130 may output only one value at a time.

In FIG. 1B, a programmable tone generator 300 contains a memory 130' of suitable construction, as is well known in the art, the memory 130' storing the Tru-Scale algorithm. The tone generator 300 is connected through a suitable interface 200, such a MIDI interface, to an electronic musical instrument 100', enabling the musical instrument to reproduce scales and chords using the Tru-Scale interval system, even though the memory of the instrument 100' may not contain the Tru-Scale algorithm. The MIDI interface is well known in the art; thus, a detailed description of the MIDI interface is not necessary here to a full appreciation of the invention.

FIG. 1C shows in block form an exemplary layout of the memory 130 for an electronic musical instrument, such as a synthesizer, according to the present invention. Synthesizers are used for reproducing many different types of sound (voices), and so the memory 130 may contain data corresponding to various musical instruments, such as a piano, an organ, a guitar, a flute, etc. When the keyboard 110 (FIG. 1A) produces a pitch determining voltage signal and keying signal in response to depression of a selected key or keys, the CPU 120 instructs the retrieval of predetermined signals from the memory 130.

The memory 130 may have stored therein data for 64 voice memories, 32 performance memories plus one (A,B,C) system setup memory and two (D) user-defined micro tunings. The Tru-Scale sequence of frequencies is programmed into the internal memory system for retrieval as desired, thus avoiding the need for multi-scale devices to eliminate dissonance caused by overtones or clashing frequencies.

Tru-Scale is a scale with tones of fixed pitch, yielding perfectly tuned chords and allowing complete freedom of modulation. These frequency data can be used for basic MIDI settings on all other instruments calling for reception, storing, or transmission of Tru-Scale frequencies, as alluded to with reference to FIG. 1B above. Further, these data may be stored for use as a dependent or independent computer source on optical or magnetic disks, in cartridges, or in semiconductor form (RAM or ROM). Data storage in memories is well known in the art, and details of implementation are not necessary here to a full appreciation of the invention.

Table I on the next page shows the algorithm for the Tru-Scale frequency, and a comparison of the internal separation between the notes of Tru-Scale and Equal Temperament. While only a few scales are shown, the pattern for continuing the algorithm in either direction (toward a higher or lower frequency) may be seen readily, and suggests applicability of the Tru-Scale system to elimination of noise, interference, etc. in any range of frequencies. The separations reflected in contemporary and of reported historical divisions are based upon Pi $\pi = 3.1416$, which provides a base that never closes, hence the continuous fractional parts, e.g. 130.81, 261.63. In contrast, the Tru-Scale separation provides a system of time-space relationships that allows a frequency to be used with other frequencies, which are compatible, and thus avoids the dissonance caused by all other interval systems.

Figure 4:
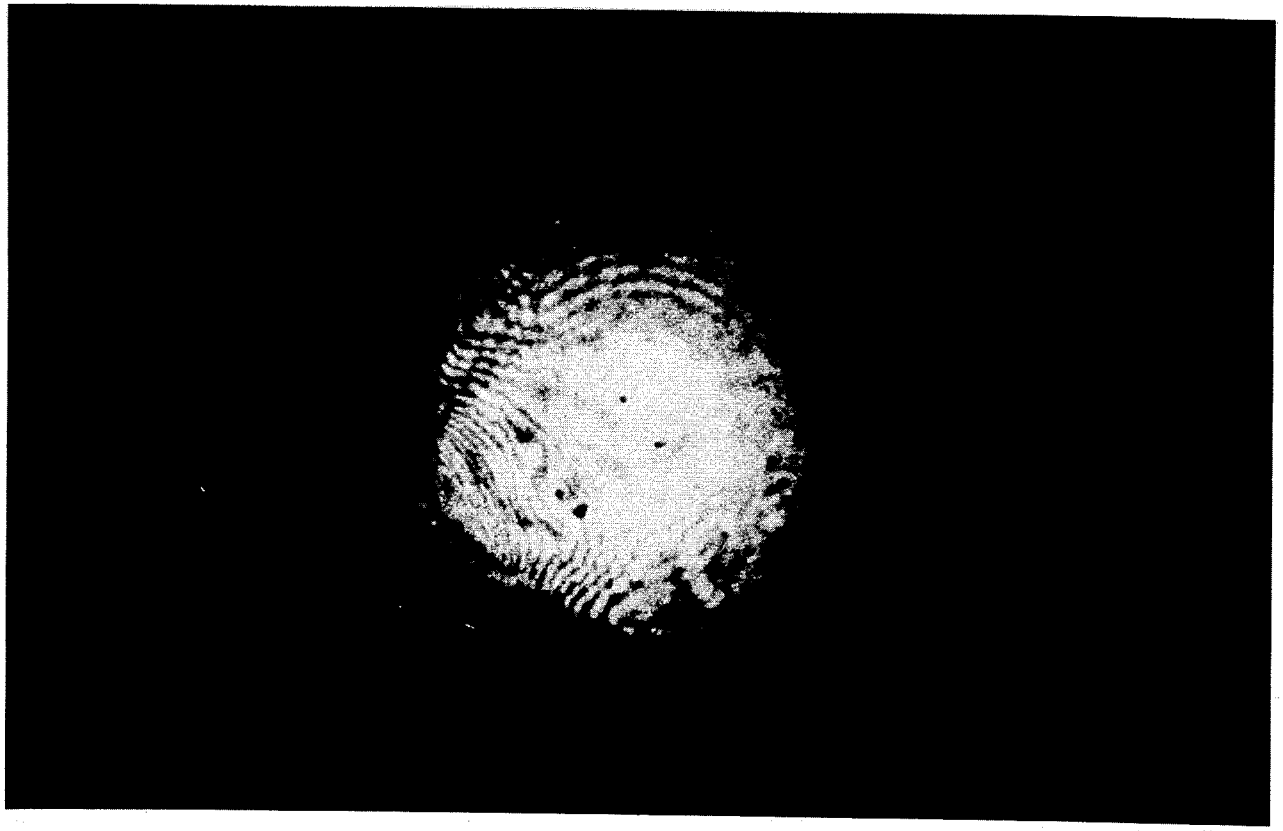
FIG. 4 is a holograph of the speaker vibrating with a standard "C" chord using the Equal Temperament scale.
Figure 5:
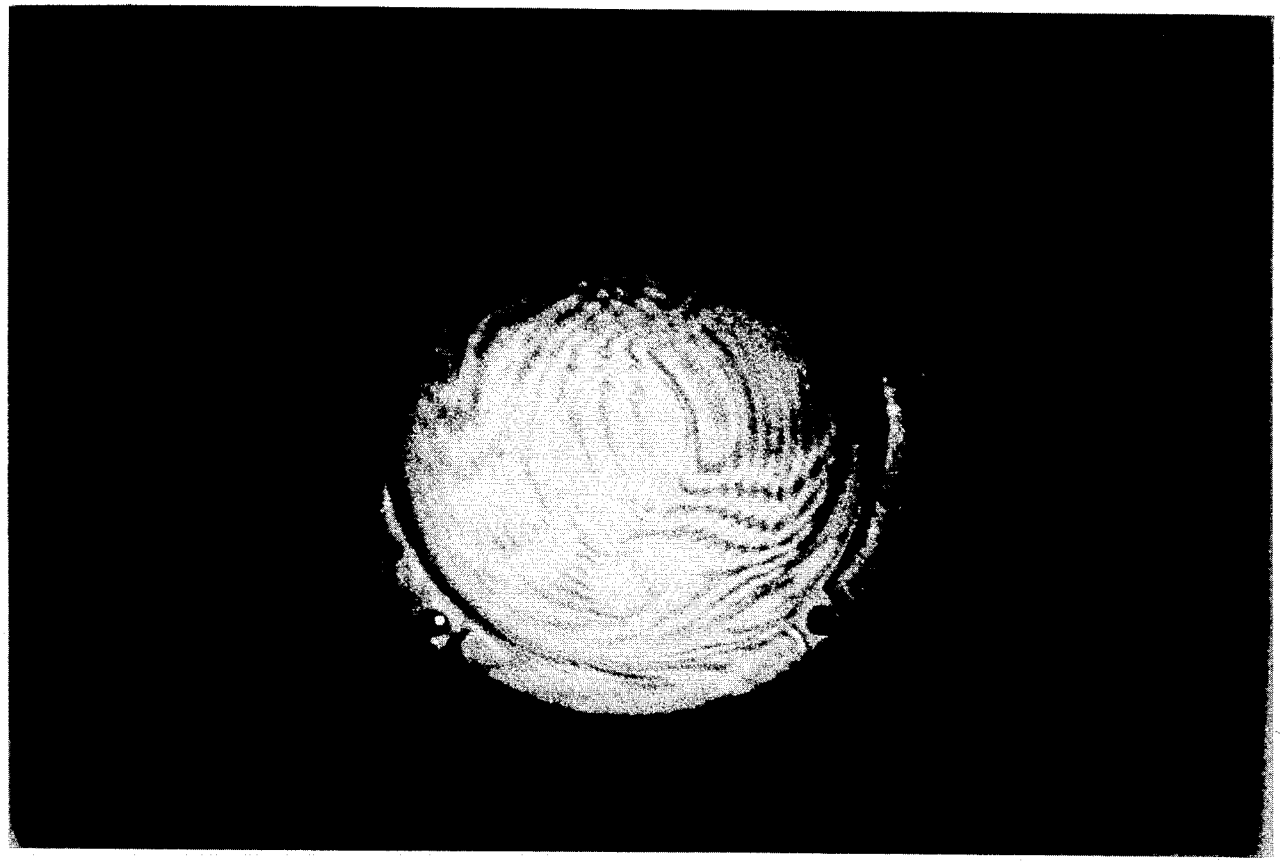
FIG. 5 is a holograph of the same speaker vibrating with a "C" chord using the Tru-Scale scale.

These mathematical data are reaffirmed in the reflection of the holographic images of FIGS. 4 and 5. All audible octave interval frequencies are stored on the memory source using the Tru-Scale octave interval system.

The relationships viewed in the presentation of the data in Table II, on the page after Table I, in regard to the "C" chord of Equal Temperament indicate the unbalanced association of the fractional extension of the interval system used. The Tru-Scale "C" chord data reflect the balance of the system and its integration of the parts to the whole which remains constant in single or mutual multiple relationships.

TABLE I

| Note | Equal Temperament Frequency(Hz) | Interval Between Notes(Hz) | Interval Between Notes(Hz) | Tru-Scale Frequency* (Hz) |
|---|---|---|---|---|
| C | 130.81 | | | 150.0 |
| C# | 138.91 | 8.10 | 7.5 | 157.5 |
| D | 146.83 | 7.92 | 10 | 167.5 |
| D# | 155.82 | 8.99 | 10 | 177.5 |
| E | 164.81 | 8.99 | 10 | 187.5 |
| F | 174.61 | 10.20 | 12.5 | 200.0 |
| F# | 185.26 | 10.65 | 12.5 | 212.5 |
| G | 196.00 | 10.74 | 12.5 | 225.0 |
| G# | 208.00 | 12.00 | 12.5 | 237.5 |
| A | 220.00 | 12.00 | 12.5 | 250.0 |
| A# | 233.97 | 13.97 | 12.5 | 262.5 |
| B | 246.94 | 12.97 | 17.5 | 280.0 |
| C | 261.63 | 14.69 | 20 | 300.0 |
| C# | 277.82 | 16.19 | 15 | 315.0 |
| D | 293.66 | 15.84 | 20 | 335.0 |
| D# | 311.64 | 17.98 | 20 | 355.0 |
| E | 329.62 | 17.98 | 20 | 375.0 |
| F | 349.22 | 20.40 | 25 | 400.0 |
| F# | 370.52 | 21.30 | 25 | 425.0 |
| G | 392.00 | 21.48 | 25 | 450.0 |
| G# | 416.00 | 24.00 | 25 | 475.0 |
| A | 440.0 | 24.00 | 25 | 500.0 |
| A# | 467.94 | 27.94 | 25 | 525.0 |
| B | 493.88 | 25.94 | 35 | 560.0 |
| C | 523.26 | 29.38 | 40 | 600.0 |

*Modified to fit Western music.

TABLE II

INTERVAL RELATIONSHIPS IN A CHORD

| Equal Temperament Frequencies (Hz) | Tru-Scale Frequencies (Hz) |
|---|---|
| "C" = 261.63 329.62 392.00 (chord) | "C" = 300 375 450 (chord) |
| 67.99 62.38 | 75 75 |
| 130.37 | 150 |
| $\frac{130.37}{261.63} = \frac{1}{2.0068267}$ | $\frac{150}{(300)} = \frac{1}{2}$ |

The historical instability of the octave, relative to a standard wave frequency, is reflected in Table III on the next page. The mean pitch frequency of a from 1495 to 1812 ranges from a high of 506 Hz to a low of 394 Hz. The "Standard a'" of 440 Hz was agreed upon by the International Organization of Standardization in 1955 (but some performers today may adopt 442 or 443 Hz as their standard a"). (Harvard Dictionary of Music, pp. 638–639.) Thus, the use of 500 Hz for a' in the Tru-Scale interval system is within the range of frequencies which have been considered for tuning purposes.

Figure 2A:
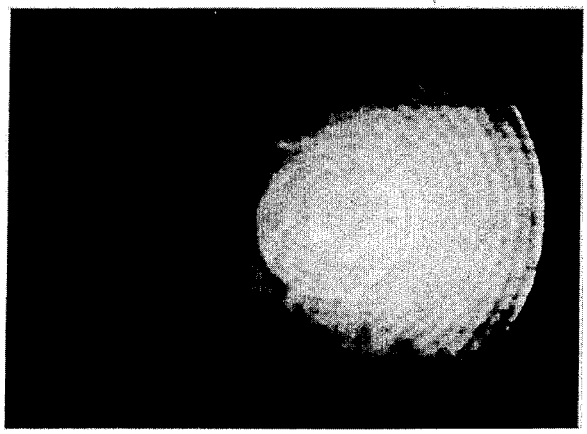
FIGS. 2A–2C are holographs of a speaker at rest (2A), the same speaker vibrating at 185 Hz (2B), and the same speaker vibrating at 220 Hz (2C)
Figure 2B:
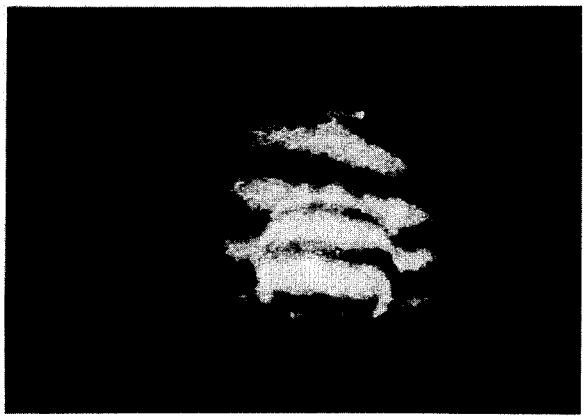
Figure 2C:
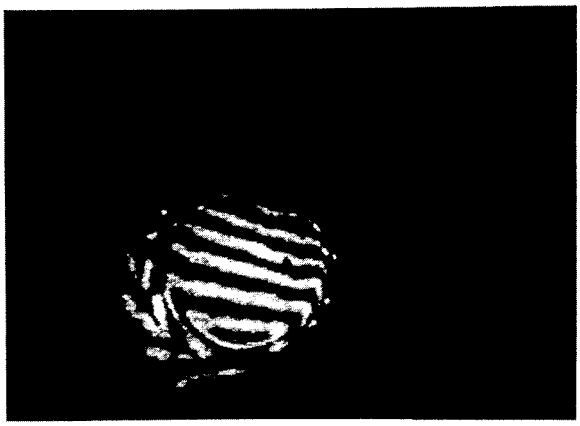

Looking now at some of the results yielded by employing the Tru-Scale interval system, FIGS. 2A2C are the result of a process known as stroboscopic holographic interferometry, in which, by stroboscopically illuminating the surface of a vibrating subject, fringe systems can be formed holographically which provide information not obtainable from time-average fringes.

TABLE III

| Mean pitch of | Instability of the Octave: Frequency of a'(Hz) | Sample pitches, 1495–1812 |
|---|---|---|
| | 506 | Halberstadt organ, 1495 |
| | 489 | Hamburg organ, 1688 |
| 15 German organs 1495–1716 | 487 | |
| 14 Silbermann organs 1717–50 | 484 | |
| 7 Austrian organs ca. 1550–1700 | 466 | |
| 48 Venetian cornettos 16th–17th c. | 466 | |
| 33 German Mincks, 16th–175h c. | 465 | |
| | 464 | Stormthal organ, 1723 |
| 25 cornettos of unknown provenance, 16th–17th c. | 461 | |
| | 455 | Hamburg organ, 1749 |
| | 454 | Amati violins, high resonance, ca. 1650 |
| | 454 | London tuning fork, ca. 1720 |
| 7 English organs, 1665–1708 | 450 | |
| 32 Italian (non-Venetian) cornettos, 16th–17th c. | 448 | |
| | 440 | Paris Conservatoire fork, 1812 |
| | 435 | Hamburg choir tuning fork, 1761 |
| 5 French cornets, 16th–17th c. | 431 | |
| | 427 | Sauveur's standard, 1713 |
| | 426 | Praetorius's Cammerton, 1619 |
| | =425 | Padua pitch pipe, 1780 |
| | 424 | Amati violins, low resonance, ca. 1650 |
| | 423 | "Handel's" tuning fork, 1751 |
| 13 English and American organs, 1740–1843 | 421 | |
| | 415 | Dresden choir tuning fork, ca. 1754–1824 |
| 6 German organs, 1693–1762 | 412 | |
| 92 French oboes, ca. 1670–1750 | 411 | |
| | 408 | Hamburg organ, 1762 |
| | 405 | Deslandes-Sauveur organ, 1704 |
| 13 French organs, 1601–1789 | 399 | |
| | 394 | De Caus's standard, 1612 |

To describe the holographic process briefly, real-time fringes are observed by (1) forming a hologram of the static surface, (2) replacing the processed hologram in its original forming position, (3) setting the surface in vibration, and (4) illuminating the surface once each vibration period with a short pulse of light. If the pulse is short enough, the method is equivalent to real-time holographic interferometry of static objects. However, by altering the phase at which the light flash appears, the vibrating surface may be compared with the static image at any phase in its vibration cycle. As with the previous real-time method, one can vary the vibration frequency, in this case keeping the light pulse and surface vibration in synchronism, and so examine the full range of frequency response of the vibrating body. This enables narrowband resonances to be studied easily.

Real-time methods allow observation of the evolution of a fringe pattern as vibration amplitude is increased from zero or as the vibration frequency is brought to the resonance value. From such observations one can count fringes, follow their movement, and detect the positions of nodes. By displacing the surface slightly in the direction of its normal and observing the motion of the fringes, the relative sign of the vibration over the mode pattern can be determined. One major advantage over the time-average system, common to nearly all the stroboscopic techniques, is that the fringes are of equal visibility independent of the amplitude of vibration. For this reason larger vibration amplitudes can be studied stroboscopically than with the time-average method.

FIG. 2A shows a loudspeaker at groundstate (i.e. not moving). FIGS. 2B and 2C show the same loudspeaker reproducing a sound of 185 Hz and 220 Hz, respectively. As can be observed from FIGS. 2B and 2C, the space between adjacent frequencies is clearly defined and is independent of any interference. Also, it should be noted that, because only a single frequency is being reproduced, the loudspeaker has only a single mode of movement, as reflected by the relative clarity with which the structure of the loudspeaker can be seen.

Figure 3:
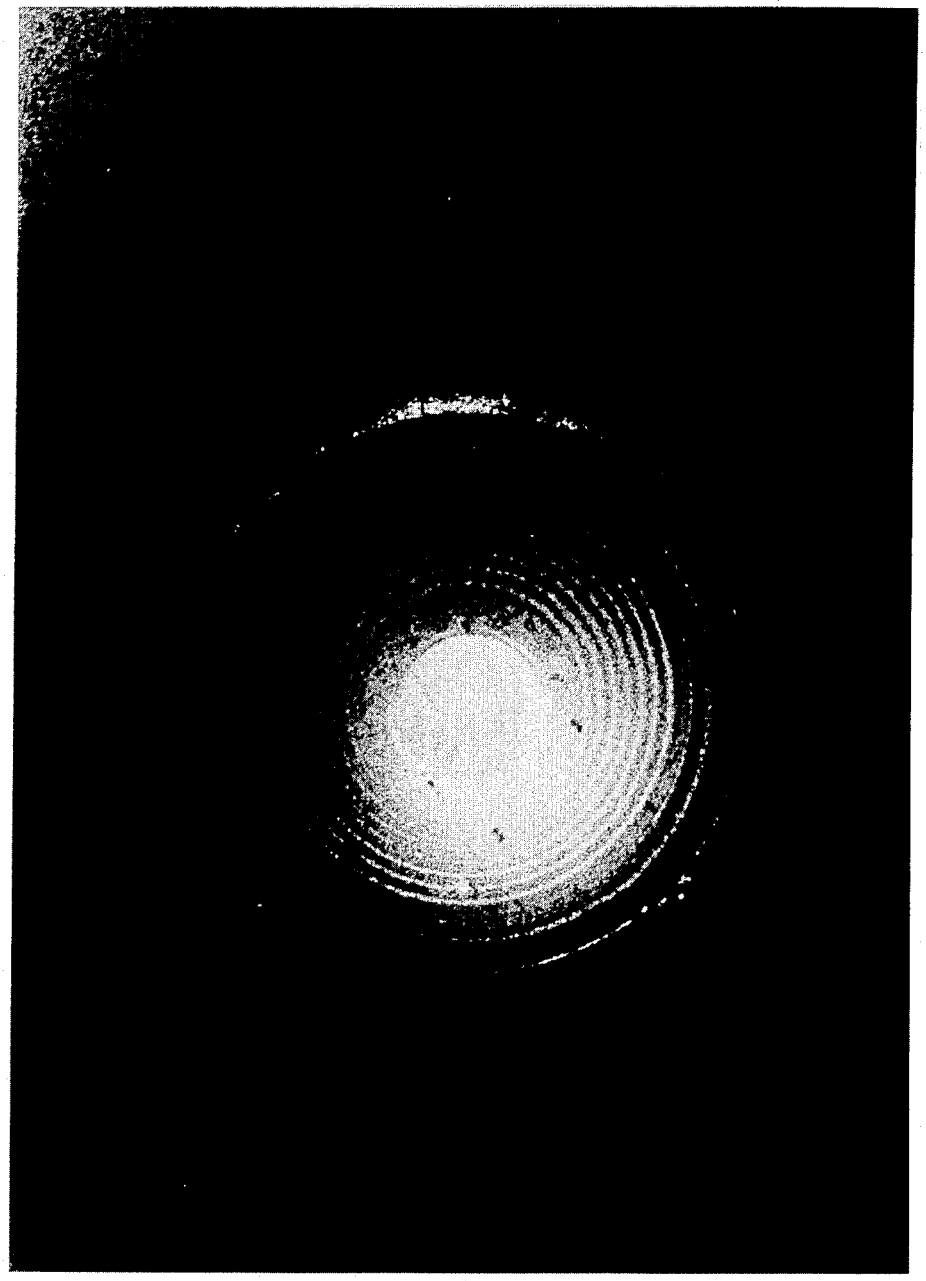
FIG. 3 is a holograph of the speaker at rest (Ground-state)

FIG. 3, a holograph, is the same speaker as in FIGS. 2A–2C. The speaker has been put into a fixed position with a ruby-red strob-laser. The speaker is at rest (groundstate), and shows no wave patterns at all.

FIG. 4, a holographic picture taken with the laser, provides a uniform fringe visibility of an Equal-Temperament "C" chord, including C=261.62 Hz, E=329.62 Hz, G=392.00 Hz. It can be observed that about 40% of the lower half of the speaker is involved in the production of the wave pattern. The closeness of the fringes and the erratic line patterns are observed when the three note chord is triggered at a constant volume. Having only about 40% of the speaker in motion during playing of a chord is clear indication of dissonance.

FIG. 5 is a holographic picture taken with the laser, using the exact same volume as observed in FIG. 4 but reproducing a Tru-Scale "C" chord, including C=300 Hz, E=375 Hz and G=450 Hz. There is shown a uniform fringe visibility that involves 100% of the speaker in motion, not just 40%, as was the case with the reproduction of the Equal-Temperament "C" chord. Having virtually 100% of the speaker in motion indicates lack of dissonance. As can be seen from FIG. 5, this Tru-Scale "C" chord has the same characteristics as the single frequency patterns found in FIGS. 2B and 2C. In addition to the well spaced waves, each frequency occupies its own space without interfering with another's. Thus, the clarity of the tone is apparent not only auditorially but also visually, depicting harmony in motion as captured by a laser illuminating the surface of a vibrating speaker.

As can be seen from the foregoing, according to the present invention, a novel interval system employed in an electronic musical instrument enables elimination of overtone collisions in struck chords, yielding a cleaner sound while retaining the same ease of transposition of scales as was possible with previous fixed scale interval systems.

While the present invention has been described in detail above with reference to a preferred embodiment, numerous variations within the spirit of the invention will be apparent to ordinarily skilled artisans. Thus, the scope of the invention is limited only by the appended claims which follow immediately.

What is claimed is:

1. In an electronic musical instrument, comprising:

a keyboard, including a plurality of keys which may be depressed singly or in combination; and means for reproducing sound in accordance with ones of said keys being depressed singly or in combination, wherein depression of said ones of said keys in combination normally results in overtone collision;

the improvement wherein said sound reproducing means includes means for eliminating said overtone collision, said overtone collision eliminating means comprising means for reproducing musical notes in accordance with an octave transformation which assigns a predetermined interval between consecutive notes in an octave, wherein operation of said sound reproducing means in conjunction with said octave transformation results in elimination of said overtone collision.

2. An electronic musical instrument as claimed in claim 1, wherein said octave transformation is as follows:

| Note | Interval | Frequency |
|---|---|---|
| C | | 150.0 |
| C# | 7.5 | 157.5 |
| D | 10 | 167.5 |
| D# | 10 | 177.5 |
| E | 10 | 187.5 |
| F | 12.5 | 200.0 |
| F# | 12.5 | 212.5 |
| G | 12.5 | 225.0 |
| G# | 12.5 | 237.5 |
| A | 12.5 | 250.0 |
| A# | 12.5 | 262.5 |
| B | 17.5 | 280.0 |
| C | 20 | 300.0 |

-continued

| Note | Interval | Frequency |
|---|---|---|
| C# | 15 | 315.0 |
| D | 20 | 335.0 |
| D# | 20 | 355.0 |
| E | 20 | 375.0 |
| F | 25 | 400.0 |
| F# | 25 | 425.0 |
| G | 25 | 450.0 |
| G# | 25 | 475.0 |
| A | 25 | 500.0 |
| A# | 25 | 525.0 |
| B | 35 | 560.0 |
| C | 40 | 600.0 |

3. An electronic musical instrument according to claim 1, wherein said overtone collision elimination means includes memory means for storing said octave transformation.

4. An electronic musical instrument according to claim 3, wherein said memory means comprises a flexible disk memory in which flexible disks may be removably inserted.

5. An electronic musical instrument according to claim 3, wherein said memory means comprises a semiconductor random access memory.

6. An electronic musical instrument according to claim 3, wherein said memory means comprises a read-only memory.

7. An electronic musical instrument according to claim 6, wherein said read-only memory comprises an optical disk read-only memory.

8. An electronic musical instrument according to claim 6, wherein said read-only memory comprises a semiconductor read-only memory.

9. In an electronic tone generator comprising:

interface means for connecting said electronic tone generator to an electronic musical instrument such that said electronic tone generator is capable of receiving signals indicative of requested tones; and means for reproducing desired tones in accordance with said signals, wherein said electronic musical instrument normally reproduces musical notes in combination such that overtone collision results;

the improvement wherein said reproducing means comprises means for eliminating said overtone collision, said overtone collision eliminating means comprising in turn means for reproducing musical notes in accordance with an octave transformation which assigns a predetermined interval between consecutive notes in an octave, wherein operation of said sound reproducing means in conjunction with said octave transformation results in elimination of said overtone collision.

10. An electronic musical instrument as claimed in claim 9, wherein said octave transformation is as follows:

| Note | Interval | Frequency |
|---|---|---|
| C | | 150.0 |
| C# | 7.5 | 157.5 |
| D | 10 | 167.5 |
| D# | 10 | 177.5 |
| E | 10 | 187.5 |
| F | 12.5 | 200.0 |
| F# | 12.5 | 212.5 |
| G | 12.5 | 225.0 |
| G# | 12.5 | 237.5 |
| A | 12.5 | 250.0 |
| A# | 12.5 | 262.5 |

-continued

| Note | Interval | Frequency |
|---|---|---|
| B | 17.5 | 280.0 |
| C | 20 | 300.0 |
| C# | 15 | 315.0 |
| D | 20 | 335.0 |
| D# | 20 | 355.0 |
| E | 20 | 375.0 |

-continued

| Note | Interval | Frequency |
|---|---|---|
| F | 25 | 400.0 |
| F# | 25 | 425.0 |
| G | 25 | 450.0 |
| G# | 25 | 475.0 |
| A | 25 | 500.0 |
| A# | 25 | 525.0 |
| B | 35 | 560.0 |
| C | 40 | 600.0 |

* * * * *